US008344873B2

(12) United States Patent
Seror

(10) Patent No.: US 8,344,873 B2
(45) Date of Patent: Jan. 1, 2013

(54) EMBEDDED SYSTEM AND METHOD FOR MONITORING AND VERIFYING AN EMERGENCY SITUATION OF A SUBJECT

(75) Inventor: Ianiv Seror, Yehud (IL)

(73) Assignee: Reflexive Ltd., Kfar Saba (IL)

( * ) Notice: Subject to any disclaimer, the term of this patent is extended or adjusted under 35 U.S.C. 154(b) by 428 days.

(21) Appl. No.: 12/640,087

(22) Filed: Dec. 17, 2009

(65) Prior Publication Data

US 2011/0148619 A1 Jun. 23, 2011

(51) Int. Cl.
*G08B 29/00* (2006.01)

(52) U.S. Cl. ..... 340/506; 600/300

(58) Field of Classification Search ..... 340/506, 340/539.12, 573.1; 128/904; 600/300
See application file for complete search history.

(56) References Cited

U.S. PATENT DOCUMENTS 5,441,047 A * 8/1995 David et al. ..... 600/483
5,842,978 A * 12/1998 Levy ..... 600/300
5,963,136 A * 10/1999 O'Brien ..... 340/573.1
6,221,010 B1 * 4/2001 Lucas ..... 600/300
6,624,750 B1 * 9/2003 Marman et al. ..... 340/506
7,817,029 B1 * 10/2010 Hillenburg et al. ..... 340/506
2007/0096927 A1 * 5/2007 Albert ..... 340/573.1

FOREIGN PATENT DOCUMENTS

WO 2007/107984 A2 9/2007

* cited by examiner

*Primary Examiner* — John A Tweel, Jr.

(74) *Attorney, Agent, or Firm* — The Law Office of Michael E. Kondoudis

(57) ABSTRACT

A method of verifying alerts received from alerting devices associated with a user. The method includes: verifying the received alerts from the user by applying a specified procedure to the user; analyzing the received alert in respect to specified temporal characteristics of the received alerts; classifying each received alert as either a false alarm or as a valid alarm according to the verifying and the analyzing; and reporting the valid alarms to a service center. Double checking the received alerts both by the verifying and the analyzing enhances alarm reliability.

11 Claims, 4 Drawing Sheets

EMBEDDED SYSTEM AND METHOD FOR MONITORING AND VERIFYING AN EMERGENCY SITUATION OF A SUBJECT

BACKGROUND

1. Technical Field

The present invention relates to the field of alerting systems, and more particularly, to false alarm reduction.

2. Discussion of Related Art

Alerting systems are common, yet frequently suffer from a high rate of false alarms.

Israeli Patent Document No. 194223 and the corresponding WIPO Publication No. WO/2007/107984, which are incorporated herein by reference in their entireties, disclose a system and method for real time monitoring of a subject and verification of an emergency situation.

BRIEF SUMMARY

Embodiments of the present invention provide an alerting system comprising: at least one alerting device associated with a user; a managing unit connected to the at least one alerting device via a communication link and arranged to receive and collect data and alerts therefrom; a verification unit connected to the managing unit and arranged to communicate with the user and verify received alerts therefrom by applying a specified procedure; and a remote server connected to the managing unit via a communication link and arranged to analyze temporal characteristics of the received data and alerts in view of the collected data and alerts and evaluate a veracity of the received alerts. The managing unit is arranged to classify each received alert as either a false alarm or as a valid alarm according to results of the verification procedure and the evaluated veracity. The managing unit is further connected via a communication link to a service center and arranged to report the valid alarms to the service center. Double checking the received alerts both by the verification unit and by the remote server enhances alarm reliability.

Embodiments of the present invention provide a method of verifying alerts received from at least one alerting device associated with a user. The method comprises the stages: verifying the received alerts from the user by applying a specified procedure to the user; analyzing the received alert in respect to specified temporal characteristics of the received alerts; classifying each received alert as either a false alarm or as a valid alarm according to the verifying and the analyzing; and reporting the valid alarms to a service center. Double checking the received alerts both by the verifying and by the analyzing enhances alarm reliability.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
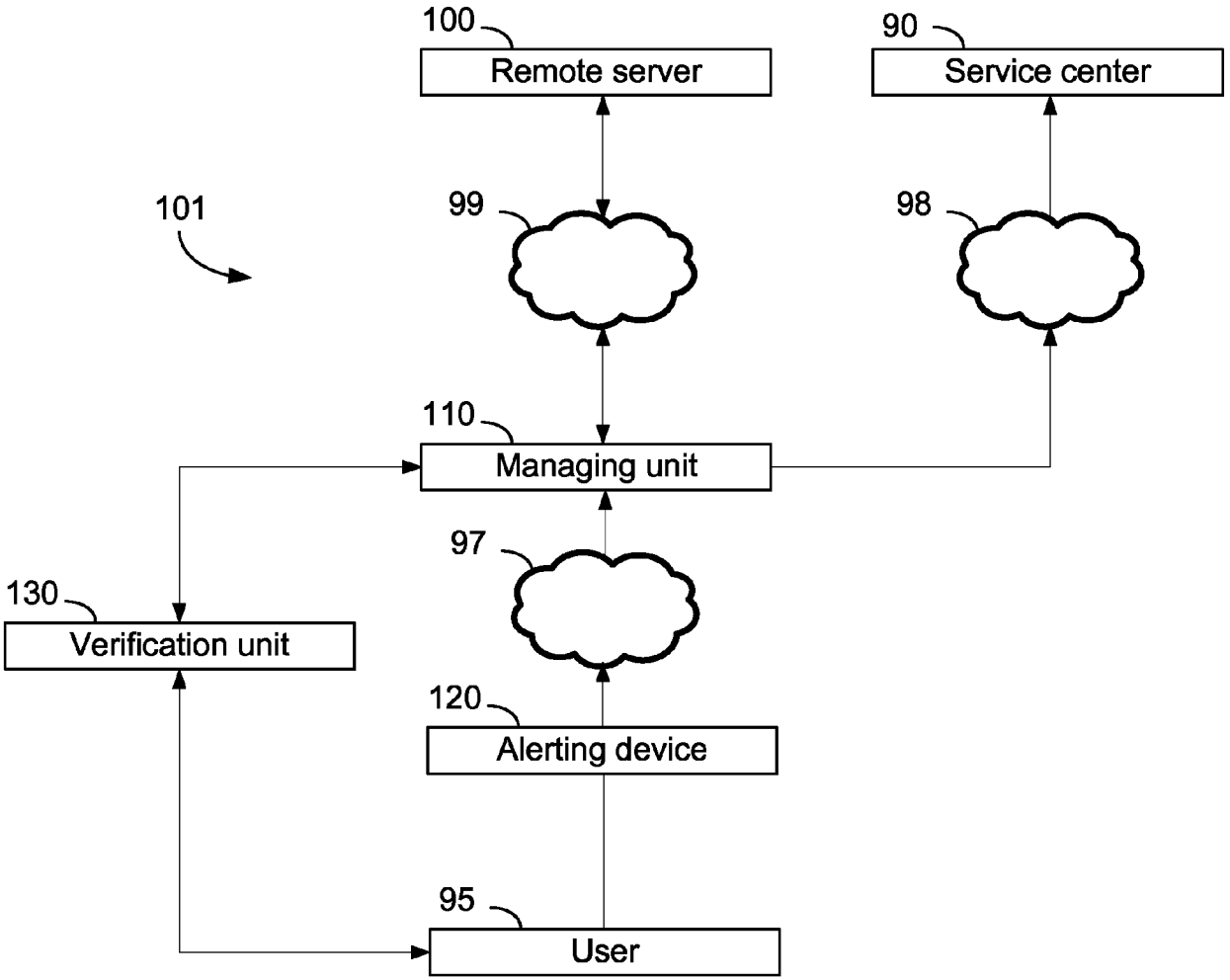
FIG. 1 is a high level schematic block diagram of an alerting system, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 is a high level schematic block diagram of an alerting system 101, according to some embodiments of the invention. Alerting system 101 comprises at least one alerting device 120 associated with a user 95; a managing unit 110 connected to alerting device 120 via a communication link 97 and arranged to receive and collect data and alerts therefrom; a verification unit 130 connected to managing unit 110 and arranged to communicate with user 95 and verify received alerts therefrom by applying a specified procedure; and a remote server 100 connected to managing unit 110 via a communication link 99 and arranged to analyze temporal characteristics of the received data and alerts in view of the collected data and alerts and evaluate a veracity of the received alerts. Managing unit 110 is arranged to classify each received alert as either a false alarm or as a valid alarm according to the verification and the evaluated veracity, and further connected via a communication link 98 to a service center 90 and arranged to report the valid alarms to service center 90. Double checking the received alerts both by verification unit 130 and by remote server 100 enhances alarm reliability.

The specified procedure may comprise asking user 95 by verification unit 130 to deactivate verification unit 130 and/or change the status of alerting device 120, to communicate with the user and verbally checking the user's well being, to remeasure user data, or to perform specified actions or inform of his state, such as to identify false alarms of alerting device. Another possibility is to stimulate the user with an audible, a visual, a vibrational or a tactile stimulus. Cases in which the specified procedure fails to deliver the expected results are indications of a valid alarm.

Remote server 100 is arranged to analyze past and current data and alerts such to enable an evaluation of the veracity of the currently received alert. For example, remote server 100 may identify patterns in past data, or identify temporal patterns in the readings of alerting device 120. Such temporal patterns may comprise abrupt changes, correlation with other indicators such as readings of other alerting devices 120 or measurements units, the time of day, and user or physician indications. The temporal characteristics may comprise a form of a measurements curve over time, or a correlation of the received data with collected data of specified similarity.

According to some embodiments of the invention, alerting system 101 acts as a relay between alerting device 120 and service center 90 by allowing double checking the alerts. For example, an alert may cause alerting system 101 to enter an active state in which the alert is verified by verification unit 130 and analyzed, and the actual alarm may be passed on to service center 90 only upon the classification of the alert as valid.

Figure 2:
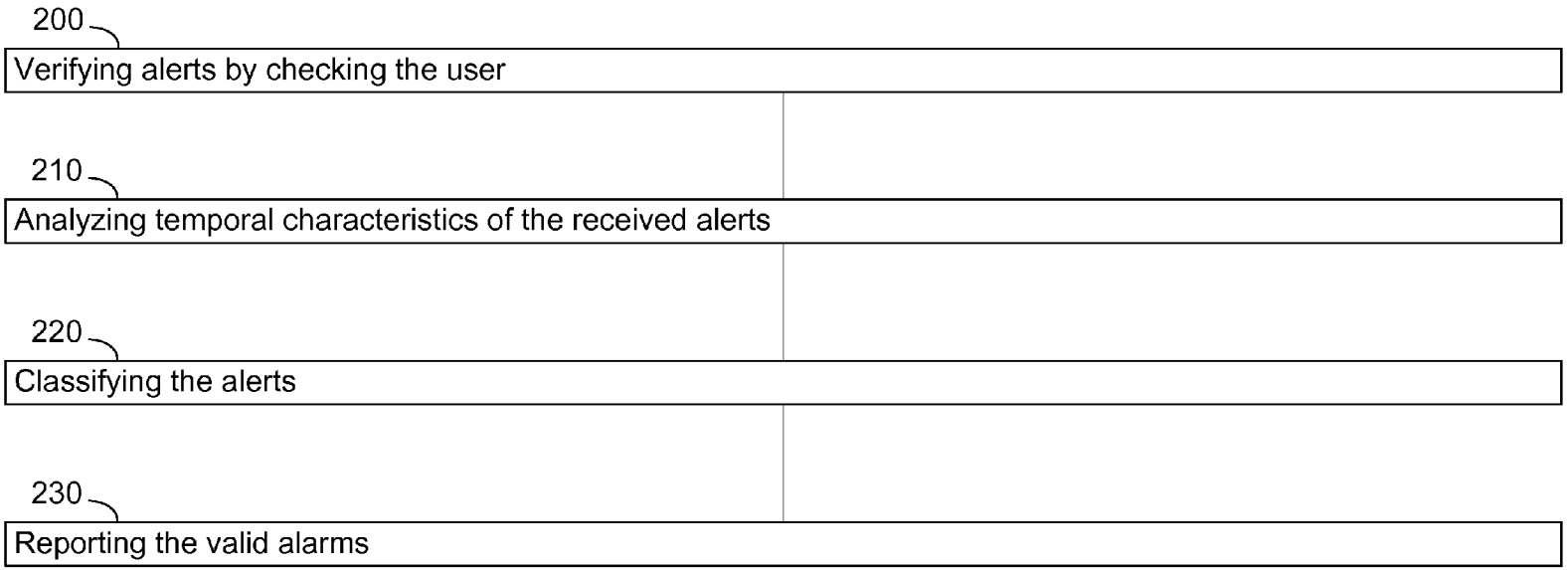
FIGS. 2 and 3 are high level flowcharts illustrating a method of verifying alerts received from at least one alerting device associated with a user, according to some embodiments of the invention.
Figure 3:
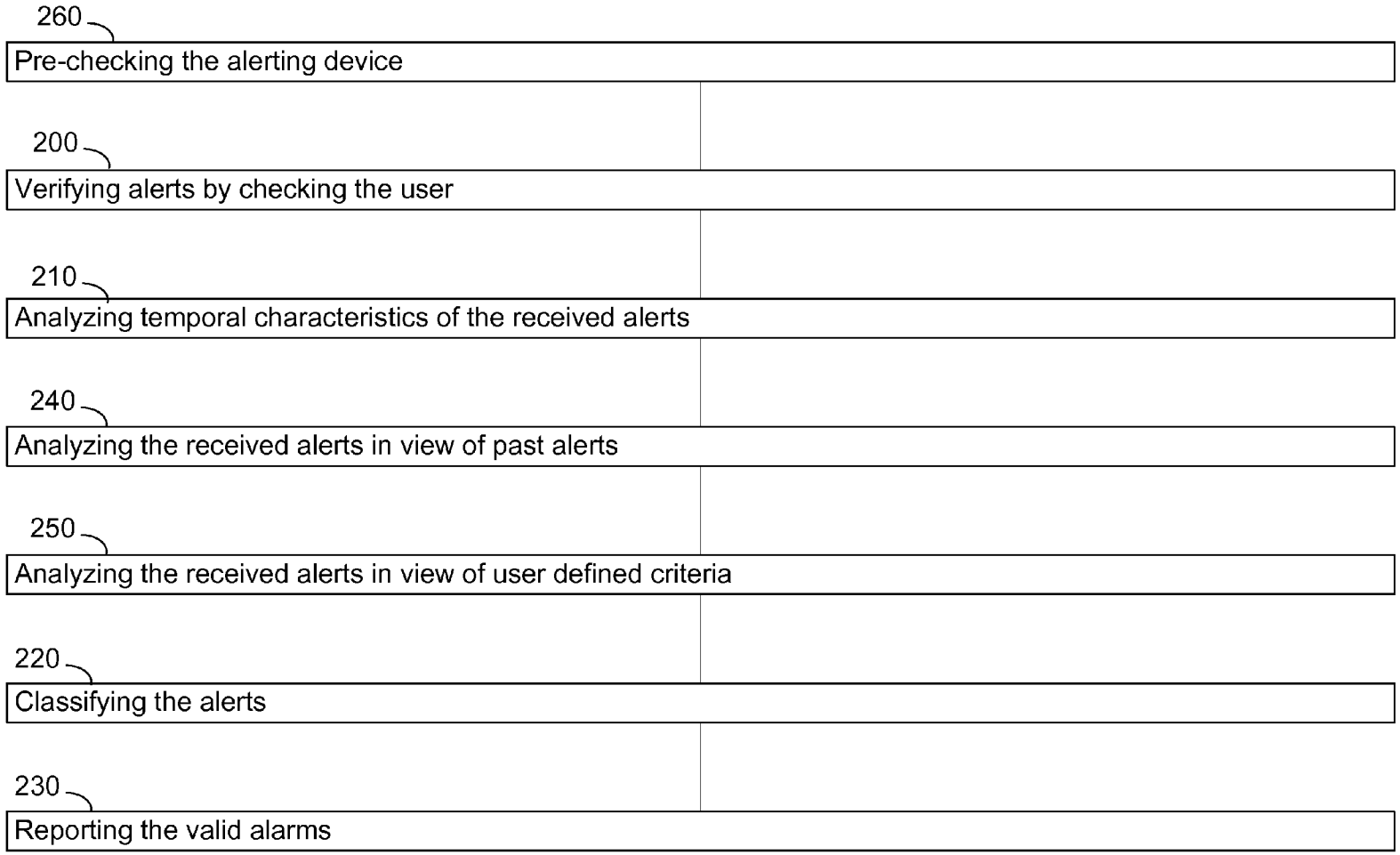

FIGS. 2 and 3 are high level flowcharts illustrating a method of verifying alerts received from at least one alerting device associated with a user, according to some embodiments of the invention. The method may comprise the following stages: verifying the received alerts from the user by applying a specified procedure to the user (stage 200); analyzing the received alert in respect to specified temporal characteristics of the received alerts (stage 210); classifying each received alert as either a false alarm or as a valid alarm according to the verifying and the analyzing (stage 220); and reporting the valid alarms to a service center (stage 230). Double checking the received alerts both by verifying the received alert with the user (stage 200) and by analyzing specified temporal characteristics of the received alert (stage 210) enhances alarm reliability.

According to some embodiments of the invention, the method may further comprise analyzing the received alerts in view of a plurality of past alerts and their analysis (stage 240) and in view of user defined criteria (stage 250).

According to some embodiments of the invention, the method may further comprise pre-checking the at least one alerting device (stage 260) such as to characterize its sensitivity ranges. Pre-checking (stage 260) then allows refining the verification (stage 200) and analysis (stage 210) such as to reduce the number of false alarms.

Figure 4:
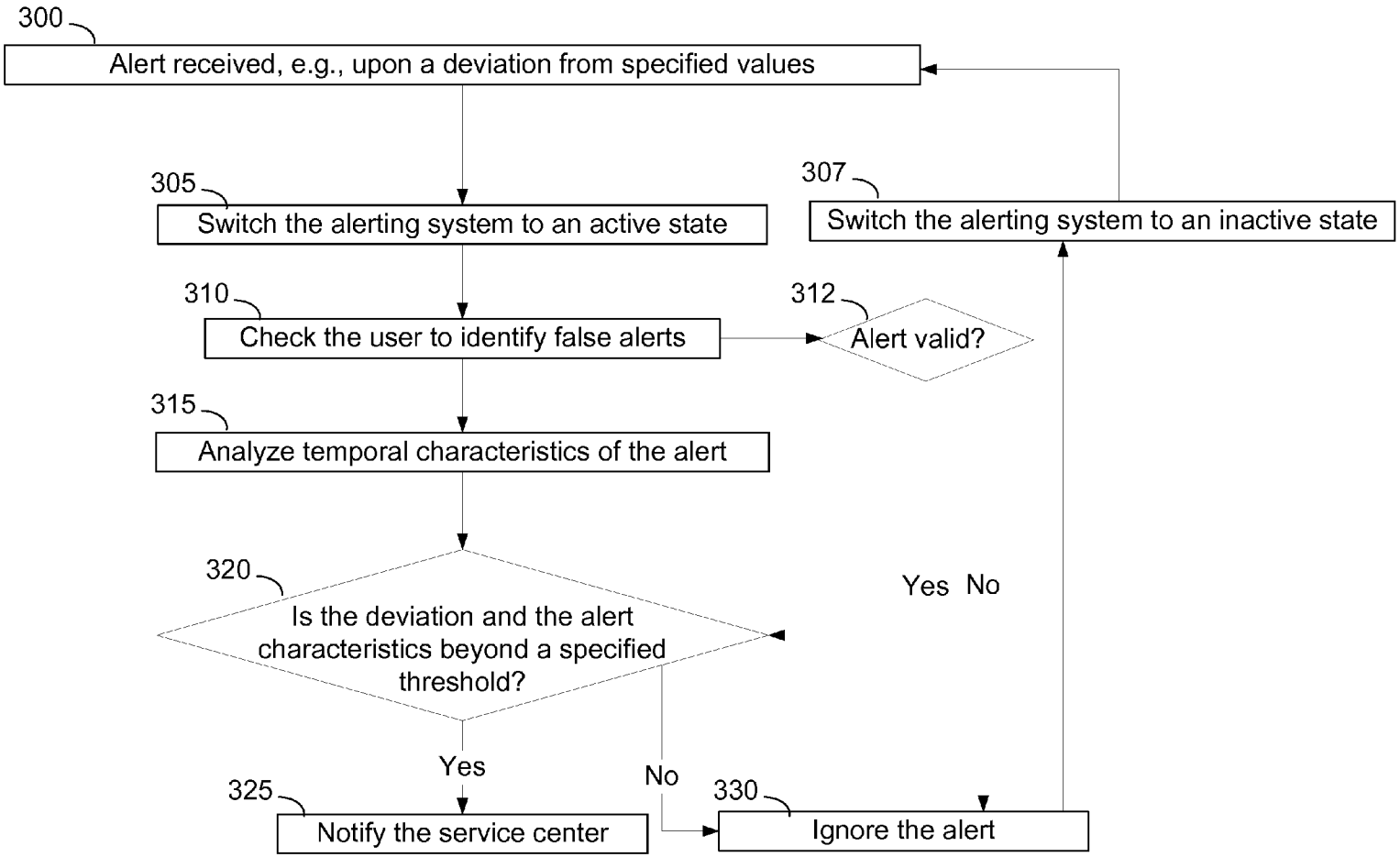
FIG. 4 is a high level flowchart illustrating the method, according to some embodiments of the invention.

FIG. 4 is a high level flowchart illustrating the method, according to some embodiments of the invention. According to some embodiments of the invention, the method may follow the following flow. When alert is received, e.g., upon a deviation from specified values (stage 300), the alerting system is switched to an active state (stage 305). The method then checks the user to identify false alerts (stage 310), e.g., by asking for a feedback, or measuring certain parameters again. If the alert is invalid (stage 312) it may be ignored (stage 330). Furthermore, the method may analyze temporal characteristics of the alert (stage 315) and if the deviation and the alert characteristics are beyond a specified threshold (stage 320), and the alert is valid (stage 312), the method may notify the service center (stage 325). Otherwise, the alert is ignored (stage 330) and the alerting system is switched to an inactive state (stage 307) operating as a standby mode, ready to receive alerts (stage 300).

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. An alerting system comprising:

at least one alerting device associated with a user;

a managing unit connected to the at least one alerting device via a communication link and arranged to receive and collect data and alerts therefrom;

a verification unit connected to the managing unit and arranged to communicate with the user and verify received alerts therefrom by applying a specified procedure; and a remote server connected to the managing unit via a communication link and arranged to analyze temporal characteristics of the received data and alerts, in view of the collected data and alerts, and to evaluate a veracity of the received alerts, wherein the managing unit is arranged to classify each received alert as either a false alarm or as a valid alarm according to results of the verification procedure and the evaluated veracity, wherein the managing unit is further connected via a communication link to a service center and arranged to report the valid alarms to the service center, wherein double checking the received alerts both by the verification unit and by the remote server enhances alarm reliability, wherein the at least one alerting device that is associated with the user is being wore on the body of the user, wherein the temporal characterstics comprise a form of a measurements' curve over time, and wherein the specified procedure comprises at least one of: communicating directly with the user and verbally checking the user's well being; and the communicating is performed by stimulating the user with at least one stimulus selected from: vibrational or tactile stimulus.

2. The alerting system of claim 1, wherein the specified procedure comprises remeasuring user data.

3. The alerting system of claim 1, wherein the temporal characteristics comprise a correlation of the received data with collected data of specified similarity.

4. The alerting system of claim 1, wherein the alerting system is arranged to enter an active state from a standby state upon receipt of the alert, and return to the standby state upon classification of the alert as a false alarm.

5. A method of verifying alerts received from at least one alerting device associated with a user, comprising:

verifying the received alerts from the user by applying a specified procedure to the user;

analyzing the received alert in respect to specified temporal characteristics of the received alerts;

classifying each received alert as either a false alarm or as a valid alarm according to the verifying and the analyzing; and reporting the valid alarms to a service center, wherein double checking the received alerts both by the verifying and the analyzing enhances alarm reliability, wherein the at least one alerting device that is associated with the user is being wore on the body of the user, wherein die specified procedure comprises at least one of:

communicating directly with the user and verbally checking the user's well being; and the communicating is performed by stimulating the user with at least one stimulus selected from: vibrational or tactile stimulus, and wherein the temporal characteristics comprise a form of a measurements' curve over time.

6. The method of claim 5, further comprising analyzing the received alerts in view of a plurality of past alerts and their analysis.

7. The method of claim 5, further comprising analyzing the received alert in view of user defined criteria.

8. The method of claim 5, further comprising pre-checking the at least one alerting device such as to characterize its sensitivity ranges.

9. The method of claim 5, further comprising entering an active state from a standby state upon receipt of the alert and returning to the standby state upon the classification of the alert as a false alarm.

10. The method of claim 5, wherein the specified procedure comprises re-measuring user data.

11. The method of claim 5, wherein the temporal characteristics comprise a correlation of the received data with collected data of specified similarity.

* * * * *